US007883347B1

(12) United States Patent
Oketani et al.

(10) Patent No.: US 7,883,347 B1
(45) Date of Patent: Feb. 8, 2011

(54) POWER CONNECTION APPARATUS

(75) Inventors: Tetsuya Oketani, Ota (JP); Masahiko Nagatake, Gunma-ken (JP); Satoshi Ishikawa, Gunma-ken (JP); Kenji Maru, Gunma-ken (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 12/826,177

(22) Filed: Jun. 29, 2010

(30) Foreign Application Priority Data

Jul. 31, 2009 (JP) ..... 2009-179025

(51) Int. Cl.
*H01R 13/60* (2006.01)

(52) U.S. Cl. ..... 439/157; 439/142; 439/160

(58) Field of Classification Search ..... 439/131, 439/171–173, 157, 574, 135, 142, 160
See application file for complete search history.

(56) References Cited

U.S. PATENT DOCUMENTS 2,288,241 A * 6/1942 Holcomb ..... 439/133
3,801,757 A * 4/1974 Carissimi et al. ..... 200/50.28
5,575,668 A * 11/1996 Timmerman ..... 439/131
5,628,641 A * 5/1997 Hahn ..... 439/131
5,701,232 A * 12/1997 Tang et al. ..... 361/679.58
6,422,763 B1 * 7/2002 Halbach et al. ..... 385/77
6,464,519 B1 * 10/2002 Hawks ..... 439/172
6,520,787 B1 * 2/2003 Lott ..... 439/218
6,939,150 B1 * 9/2005 Lanni ..... 439/131
6,971,920 B2 * 12/2005 Crupi ..... 439/654
7,094,085 B2 * 8/2006 Bona et al. ..... 439/172

FOREIGN PATENT DOCUMENTS

JP 11-273775 A 10/1999

* cited by examiner

*Primary Examiner*—Neil Abrams
*Assistant Examiner*—Phuongchi T Nguyen
(74) *Attorney, Agent, or Firm*—Westerman, Hattori, Daniels & Adrian, LLP

(57) ABSTRACT

There is disclosed a power connection apparatus which can secure connection between a power socket and a power plug and which can simplify the connecting operation properties thereof. A handle rotatably attached to the power plug having terminals includes engaging claw disengageably engaged with engagement portion of the power socket having an electrode portion, an abutment portion which abuts on the power socket, and a grip portion. The rotation of the grip portion in such a direction as to come away from the power socket is limited by the angle of the rotation of the handle in a direction in which the grip portion comes close to the power socket.

6 Claims, 18 Drawing Sheets

POWER CONNECTION APPARATUS

BACKGROUND OF THE INVENTION

The present invention relates to a power connection apparatus for supplying a power to, for example, an illuminative lamp or the like in a showcase.

In general, a showcase or the like is provided with a power connection apparatus constituted of a power socket connected into a chamber of a main body and a power plug plugged in this power socket to supply a power to an illuminative lamp or the like. In a conventional power connection apparatus disclosed in, for example, Japanese Patent Application Laid-Open No. 11-273775 (the patent document), a power socket is provided with a recess portion in which an electrode portion is disposed. This electrode portion is provided with plug-in ports for a power source. A power plug comprises a main body and a cylindrical portion connected to an illuminative lamp or the like via a wiring line, and terminals are provided on a bottom portion inside the cylindrical portion. In consequence, the power plug is plugged in the electrode portion of the power socket by plugging the terminals of the power plug in the power source plug-in ports of the power socket.

When the power connection apparatus is used in a low temperature showcase, the power plug serves for each of illuminative lamps and the like provided under front ends of a plurality of shelf devices arranged in the chamber. In a case where the layout or the like of the chamber is changed, the arrangement positions of the shelf devices are changed. Accordingly, the power socket to be connected to the power plug is also changed.

On the other hand, when the power connection apparatus is provided on an back surface in the chamber which becomes a low temperature in the showcase, humidity generated in the chamber easily invades each connecting portion between the electrode portion and the terminal. The invasion of the humidity causes electrical leakage or incurs the rusting of the terminals and the like. Moreover, frost is generated between the power plug and the power socket, which causes a problem that with the growth of the frost, a force is applied in a direction in which the power plug is detached from the power socket, and the power plug drops down.

To solve the problem, a preventive structure is employed in the connecting portion between the power plug and the power socket. However, this obstructs the attachment/detachment operation of the power plug and the power socket. Furthermore, in a low temperature environment, air in the power socket contracts, and accordingly, the attachment/detachment operation further becomes difficult.

Therefore, to secure the connection between the power plug and the power socket, there has heretofore been developed a constitution in which engagement portions are provided on a power socket side, a handle rotatable at one end thereof is provided on a power plug side, and the handle has the other end provided with engaging claws disengageably engaged with the engagement portions on the power socket side.

In the above conventional constitution, when the power plug is connected to the power socket, the terminals of the power plug are pushed into power source portions of the power socket in a state where the handle is raised, whereby the engaging claws formed at the end of the handle are engaged with the engagement portions on the power socket side owing to the elastic force of the claws. However, the power socket attached in the showcase is usually provided on the back surface in the chamber, and hence an operator performs an operation of pushing the power plug into the power socket provided on the back surface in the chamber from the front side of the showcase. In this case, the operator is distant from the back surface in the chamber to a considerable degree, and hence to facilitate the operation, it is required that the power plug is pushed into the power socket in a state where the handle of the power plug is brought down to the front side, and then the handle is upwardly rotated to engage the engaging claws of the power plug with the engagement portions of the power socket.

Moreover, in the constitution, the handle can further rotate downwardly from substantially right angles with respect to the power socket, and hence when the end of the handle on the power socket side abuts on the power socket in a state where the handle is rotated downwardly on the front side owing to the own weight thereof, the abutment portion disturbs and disenables the operation of rotating the handle upwardly. In consequence, after once rotating the handle upwardly, the power plug has to be inserted into the power socket while keeping the position of the handle, and a problem occurs that connecting operation properties become complicated.

The present invention has been developed to solve the conventional technical problem, and an object thereof is to provide a power connection apparatus which can secure connection between a power socket and a power plug and which can simplify the connecting operation properties thereof.

SUMMARY OF THE INVENTION

To achieve the above object, according to a first aspect of the present invention, there is provided a power connection apparatus which is constituted of a power socket including an electrode portion and a power plug including terminals electrically connected to the electrode portion, the apparatus comprising: an engagement portion formed in the power socket; and a handle including a grip portion at one end thereof and an abutment portion at the other end, a pivoting portion positioned between the ends being rotatably attached to the power plug, characterized in that this handle includes engaging claw positioned at the pivoting portion or on the side of the grip portion from the pivoting portion to be disengageably engaged with the engagement portion of the power socket; when the power plug is pressed onto the power socket in such a direction as to connect the terminals to the electrode portion and the abutment portion of the handle abuts on the power socket, the handle is rotated in a direction in which the grip portion comes close to the power socket, and the engaging claw engages with the engagement portion; and when the handle is rotated from the state in a direction in which the grip portion comes away from the power socket, the engagement between the engaging claw and the engagement portion and the connection between the electrode portion and the terminals are released and the rotation of the handle in the direction in which the grip portion comes away from the power socket is limited by the rotation angle of the handle in the direction in which the grip portion comes close to the power socket when the abutment portion abuts on the power socket.

According to a second aspect of the present invention, there is provided a power connection apparatus which is constituted of a power socket including an electrode portion and a power plug including terminals electrically connected to the electrode portion, the apparatus comprising: an engagement portion formed in the power socket; and a handle including a grip portion at one end thereof and an abutment portion at the other end, a pivoting portion positioned between the ends being rotatably attached to the power plug, characterized in that the handle includes engaging claw positioned at the pivoting portion or on the side of the grip portion from the pivoting portion to be disengageably engaged with the engagement portion of the power socket; when the power plug is pressed onto the power socket in such a direction as to connect the terminals to the electrode portion and the abutment portion of the handle abuts on the power socket, the handle is rotated in a direction in which the grip portion comes close to the power socket, and the engaging claw engages with the engagement portion; and when the handle is rotated from the state in a direction in which the grip portion comes away from the power socket, the engagement between the engaging claw and the engagement portion and the connection between the electrode portion and the terminals are released, and the power plug is provided with a rotation regulating structure which stops the rotation of the handle in the direction in which the grip portion comes away from the power socket at a position where an intersection angle with the power socket is less than 90°.

A third aspect of the present invention is characterized in that in the above aspects of the invention, the handle abuts on the surface of the power plug opposite to the terminals, to limit or stop the rotation of the handle.

A fourth aspect of the present invention is characterized in that in the above aspects of the invention, the engaging claw can be disengageably engaged with the engagement portion, even when the abutment portion does not abut on the power socket but the power plug is pressed onto the power socket.

A fifth aspect of the present invention is characterized in that in the above aspects of the invention, the power socket comprises a drip-proof cover which covers the electrode portion in a state where the terminals of the power plug are not connected to the electrode portion.

A sixth aspect of the present invention is characterized in that in the above aspects of the invention, the power socket comprises a holding portion disposed beside the electrode portion to detachably hold the drip-proof cover, the drip-proof cover comprises a connection arm extended with an elasticity and having a tip rotatably supported by the power socket, and the connection arm projects from a position different from a position where a line connecting the tip to the center of the drip-proof cover intersects with the drip-proof cover, and extends toward the tip thereof.

According to the first aspect of the present invention, the power connection apparatus which is constituted of the power socket including the electrode portion and the power plug including the terminals electrically connected to the electrode portion comprises the engagement portion formed in the power socket; and the handle including the grip portion at the one end thereof and the abutment portion at the other end, the pivoting portion positioned between the ends being rotatably attached to the power plug. This handle includes the engaging claw positioned at the pivoting portion or on the side of the grip portion from the pivoting portion to be disengageably engaged with the engagement portion of the power socket. When the power plug is pressed onto the power socket in such a direction as to connect the terminals to the electrode portion and the abutment portion of the handle abuts on the power socket, the handle is rotated in the direction in which the grip portion comes close to the power socket, and the engaging claw engages with the engagement portion. When the handle is rotated from the state in the direction in which the grip portion comes away from the power socket, the engagement between the engaging claw and the engagement portion and the connection between the electrode portion and the terminals are released and the rotation of the handle in the direction in which the grip portion comes away from the power socket is limited by the rotation angle of the handle in the direction in which the grip portion comes close to the power socket when the abutment portion abuts on the power socket. Consequently, when the power plug is connected to the power socket, the power plug is further pushed into a power socket side in a state where the abutment portion of the handle having the rotation angle being regulated abuts on the power socket, whereby in a state where the abutment portion abuts on the power socket, the grip portion of the handle is rotated in such a direction as to come close to the power socket, and the engaging claw of the handle is smoothly engaged with the engagement portion of the power socket.

In consequence, the abutment portion of the handle having the rotation angle regulated can abut on the power socket at an appropriate angle, and by the operation of pushing the power plug into the power socket in this state, the handle is rotated in the direction in which the grip portion comes close to the power socket, whereby the engaging claw can be engaged with the engagement portion, and connecting operation properties can be improved.

To disengage the power plug from the power socket, the grip portion of the handle is rotated in such a direction as to come away from the power socket, the abutment portion of the handle which abuts on the power socket is pressed toward a power socket side by the principle of leverage, which releases the engagement between the power plug and the power socket.

In consequence, the connection between the power plug and the power socket can be secured by the engagement between the engaging claw and the engagement portion, and the connecting operation properties and removal operation properties can be improved.

According to the second aspect of the present invention, the power connection apparatus which is constituted of the power socket including the electrode portion and the power plug including the terminals electrically connected to the electrode portion comprises the engagement portion formed in the power socket, and the handle including the grip portion at the one end thereof and the abutment portion at the other end, the pivoting portion positioned between the ends being rotatably attached to the power plug. This handle includes the engaging claw positioned at the pivoting portion or on the side of the grip portion from the pivoting portion to be disengageably engaged with the engagement portion of the power socket. When the power plug is pressed onto the power socket in such a direction as to connect the terminals to the electrode portion and the abutment portion of the handle abuts on the power socket, the handle is rotated in the direction in which the grip portion comes close to the power socket, and the engaging claw engages with the engagement portion. When the handle is rotated from the state in the direction in which the grip portion comes away from the power socket, the engagement between the engaging claw and the engagement portion and the connection between the electrode portion and the terminals are released, and the power plug is provided with the rotation regulating structure which stops the rotation of the handle in the direction in which the grip portion comes away from the power socket at the position where the intersection angle with the power socket is less than 90°. Therefore, when the power plug is connected to the power socket, the power plug is further pushed into the power socket side in a state where the abutment portion of the handle rotated to the angle regulated by the rotation regulating structure abuts on the power socket, whereby in a state where the abutment portion abuts on the power socket, the grip portion of the handle is rotated in such a direction as to come close to the power socket, and the engaging claw of the handle is smoothly engaged with the engagement portion of the power socket.

In consequence, by the operation of pushing the power plug into the power socket, the handle rotated in such a direction as to come away from the power socket is smoothly rotated in such a direction as to come close to the power socket by the rotation regulating structure, whereby the engaging claw can be engaged with the engagement portion, and the connecting operation properties can be improved.

To disengage the power plug from the power socket, the grip portion of the handle is rotated in such a direction as to come away from the power socket, the abutment portion of the handle which abuts on the power socket is pressed toward the power socket side by the principle of leverage, which releases the engagement between the power plug and the power socket.

In consequence, the connection between the power plug and the power socket can be secured by the engagement between the engaging claw and the engagement portion, and the connecting operation properties and removal operation properties can be improved.

According to the third aspect of the present invention, in addition to the above aspects of the invention, the handle abuts on the surface of the power plug opposite to the terminals, to limit or stop the rotation of the handle, whereby the rotation of the handle can be limited or stopped by a simple constitution. Productivity can be improved.

According to the fourth aspect of the present invention, in addition to the above aspects of the invention, the engaging claw can be disengageably engaged with the engagement portion, even when the abutment portion does not abut on the power socket but the power plug is pressed onto the power socket.

According to the fifth aspect of the present invention, in addition to the above aspects of the invention, the power socket comprises the drip-proof cover which covers the electrode portion in the state where the terminals of the power plug are not connected to the electrode portion. Therefore, the drip-proof cover is attached to the electrode portion of the power socket in a state where the power plug is not connected to the power socket, which can suppress a disadvantage that the electrode portion of the power socket is exposed to cold air and dew condensation water invades the inside.

According to the sixth aspect of the present invention, in addition to the above aspects of the invention, the power socket comprises the holding portion disposed beside the electrode portion to detachably hold the drip-proof cover. Therefore, also when the power plug is connected to the power socket and used, it is not necessary to separately store the only drip-proof cover, and it is possible to avoid a disadvantage that the drip-proof cover is lost.

Moreover, the drip-proof cover comprises the connection arm extended with the elasticity and having the tip rotatably supported by the power socket, and the connection arm projects from the position different from the position where the line connecting the tip to the center of the drip-proof cover intersects with the drip-proof cover, and extends toward the tip thereof. Therefore, the length of the connection arm can further be increased in a limited space, and the length required during the attachment/detachment to/from the electrode portion or the holding portion can be achieved owing to the elasticity of the connection arm.

In consequence, while the drip-proof cover is preferably pivotally supported by the power socket, the attachment/detachment operation properties of the electrode portion and the holding portion of the drip-proof cover can be improved.

DETAILED DESCRIPTION OF THE PREFERRED EMBODIMENT

Figure 1:
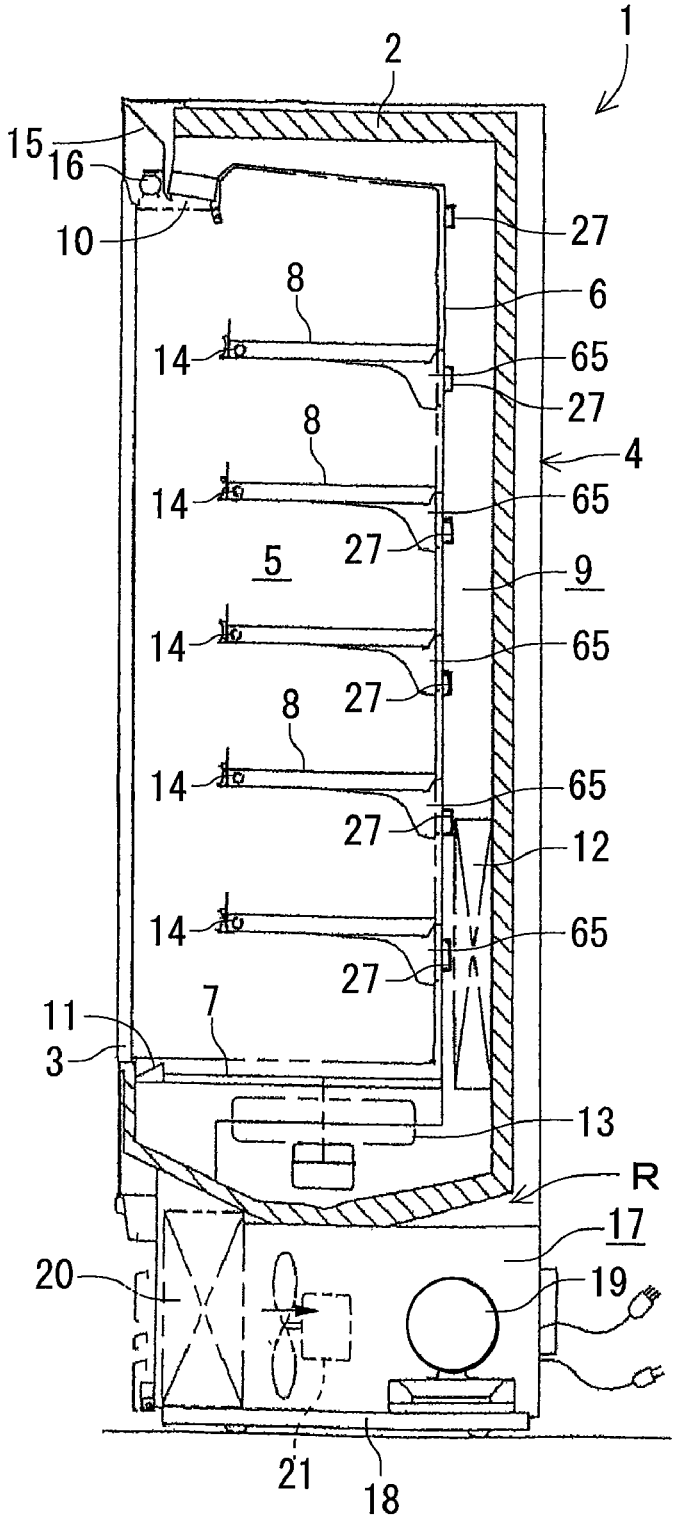
FIG. 1 is a schematic vertical side view of a low temperature showcase to which the present invention is applied.

Hereinafter, a low temperature showcase 1 to which the present invention is applied will be described with reference to a schematic vertical side view of FIG. 1. The low temperature showcase 1 is installed in a store such as a supermarket or a convenience store, and side plates 3 and 3 are attached to both sides of an insulating wall 2 having a U-shaped cross section to constitute a main body 4. A partition plate 6 and a bottom plate 7 are attached inside the insulating wall 2 with a space therefrom, to constitute a display chamber 5 having an open front surface inside these components, and a series of cold air duct 9 is also interposed between these components and the insulating wall 2.

Furthermore, the duct 9 is connected to a discharge port 10 which opens at the upper edge of an opening of the display chamber 5 and to a suction port 11 which opens at the lower edge of the opening. Moreover, in the cold air duct 9 disposed along a back surface, a cooler 12 included in a cooling apparatus R is vertically provided, and in the cold air duct 9 under the bottom plate 7, a blower 13 is installed.

In the display chamber 5, a plurality of stages of shelves 8 . . . are vertically provided. Each of the shelves 8 is held by a support (not shown) provided in the display chamber 5 via brackets 65 and 65 attached on left and right sides. The support is provided with a plurality of vertically arranged engagement holes so that the attachment positions of the shelves 8 disposed on the support via engaging claws (not shown) formed at the rear ends of the brackets 65 can arbitrarily be changed. Moreover, on the lower surface of the shelf 8, there is detachably attached an illuminative lamp 14 for illuminating commodities on the lower shelf 8 and the front part of the display chamber 5.

Moreover, a canopy 15 is positioned before the discharge port 10 at the upper edge of the opening in the front surface of the insulating wall 2, and an illuminative lamp 16 for illuminating the inside of the display chamber 5 or the periphery of the display chamber 5 is attached to the lower portion of the canopy 15.

On the other hand, a machine chamber 17 is formed under the insulating wall 2, and a unit base 18 is provided in the machine chamber 17. Moreover, a compressor 19, a condenser 20 and a blower 21 for the condenser included in the cooling apparatus R are installed on the unit base 18 and arranged in the machine chamber 17.

According to the above constitution, when the blower 13 is operated, cold air subjected to heat exchange between the cold air and the cooler 12 is raised through the duct 9, and discharged into the display chamber 5 through the discharge port 10. Subsequently, the cold air sucked through the suction port 11 is again accelerated by the blower 13, and circulated through the display chamber 5, to cool the inside of the display chamber 5 to a predetermined temperature.

Figure 2:
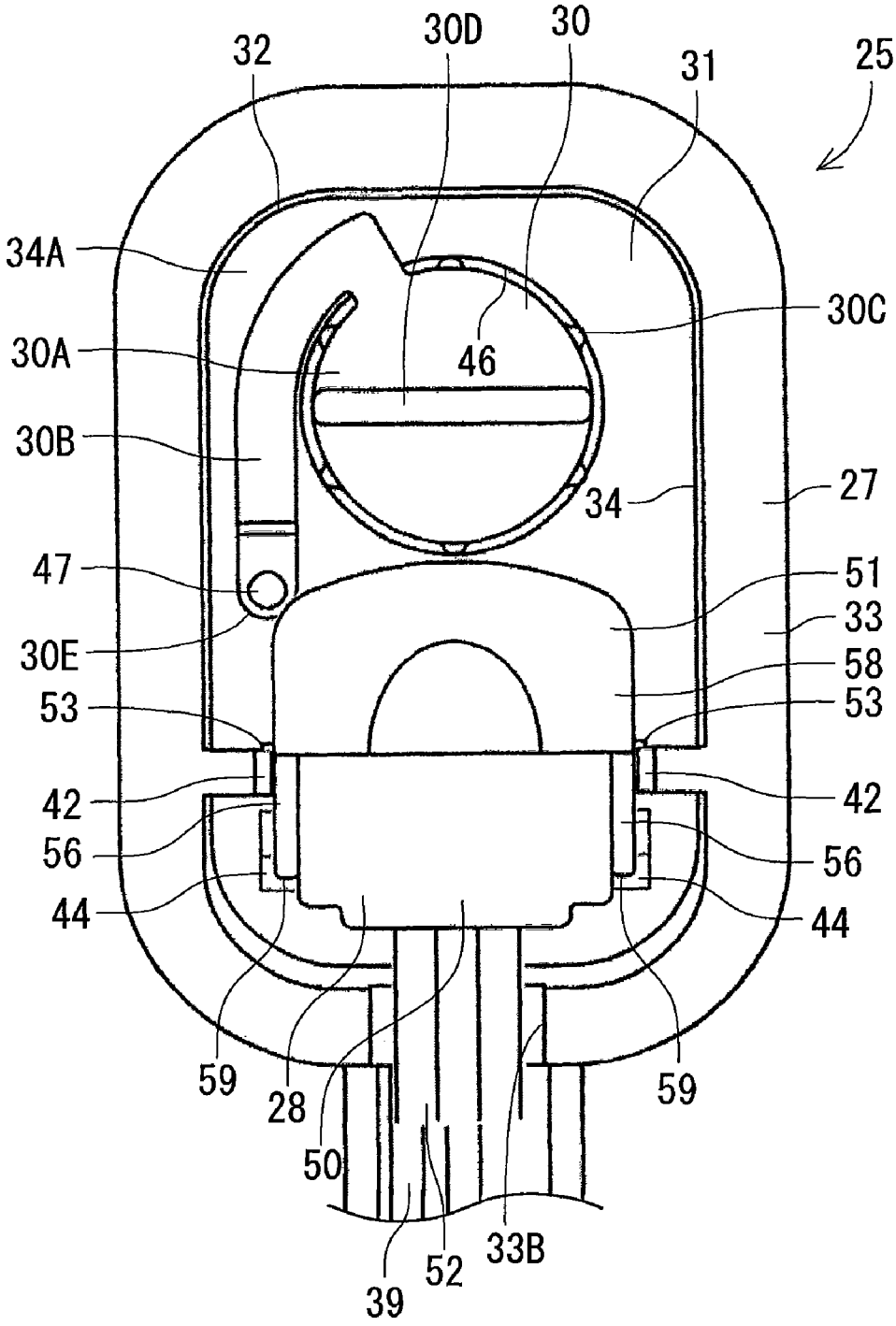
FIG. 2 is a front view of a power connection apparatus of the present invention.
Figure 3:
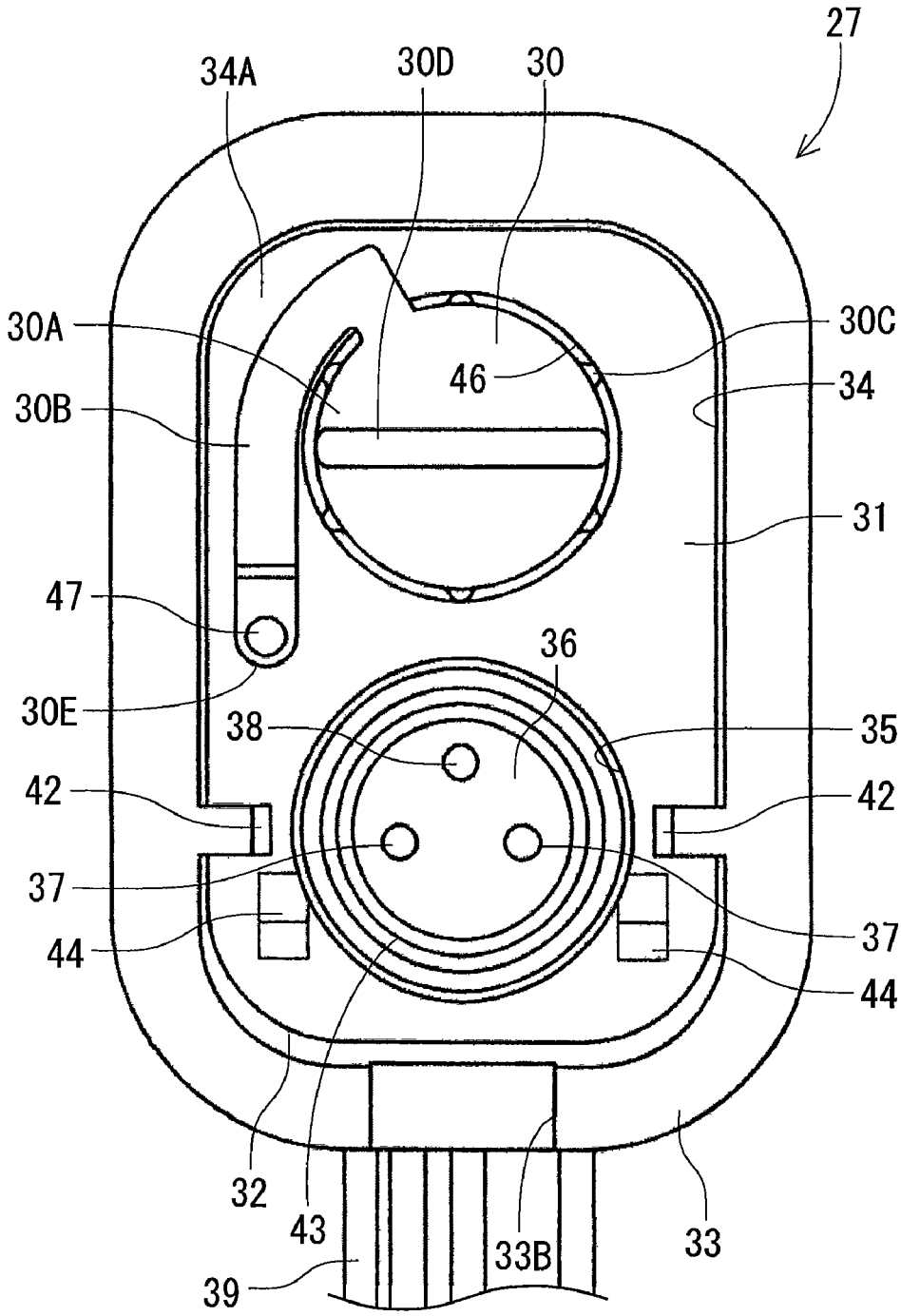
FIG. 3 is a front view of a power socket.
Figure 4:
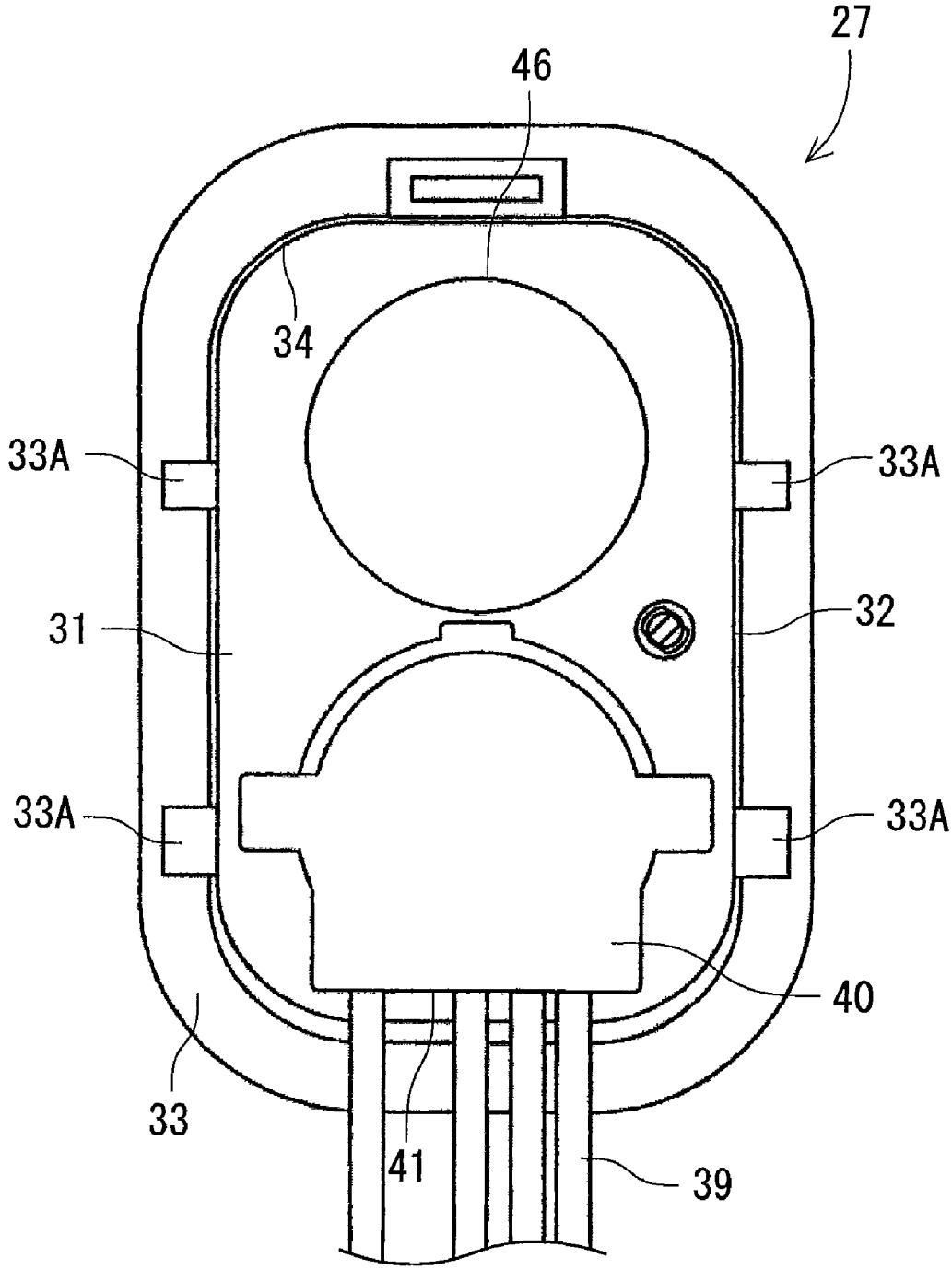
FIG. 4 is a back view of the power socket.
Figure 5:
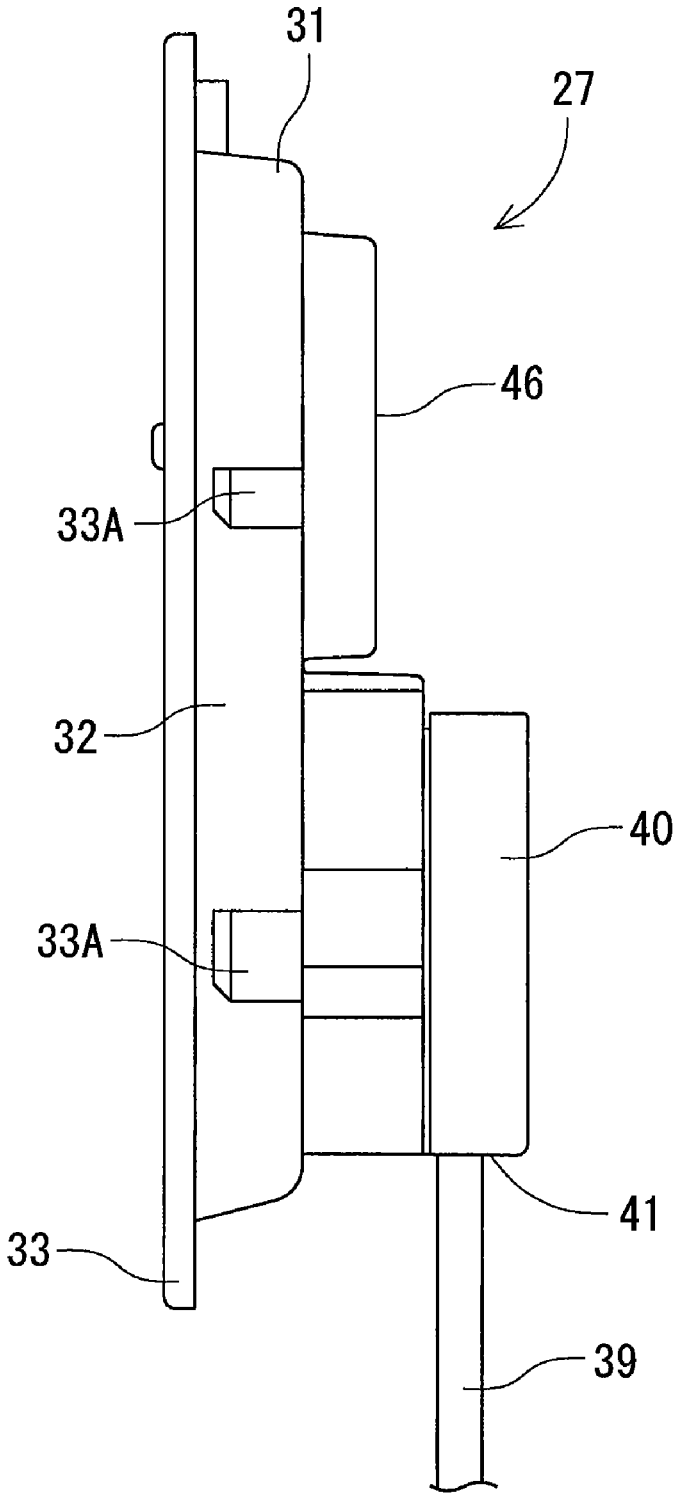
FIG. 5 is a right side view of the power socket.
Figure 7:
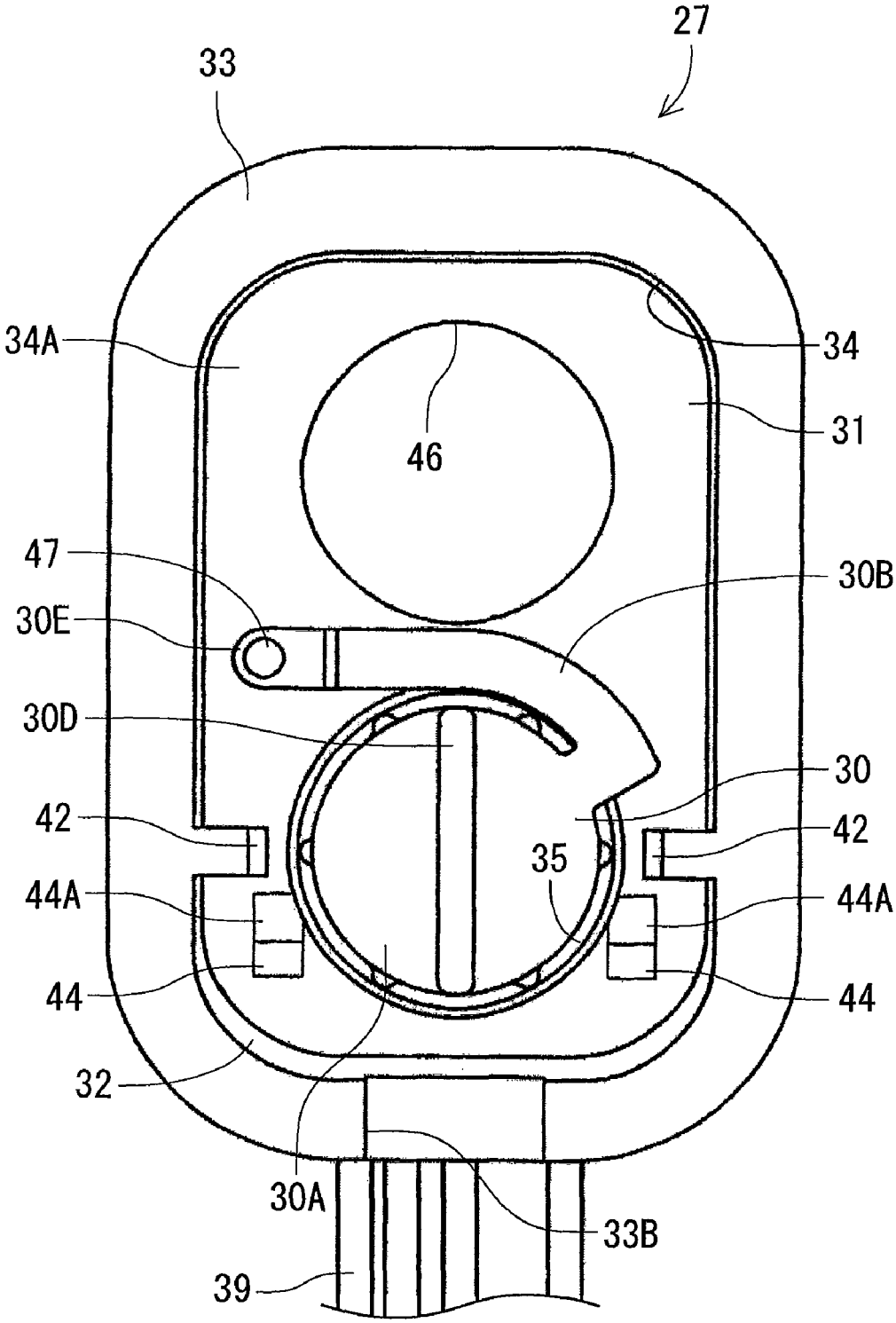
FIG. 7 is a front view of the power socket to which a drip-proof cover is attached.
Figure 8:
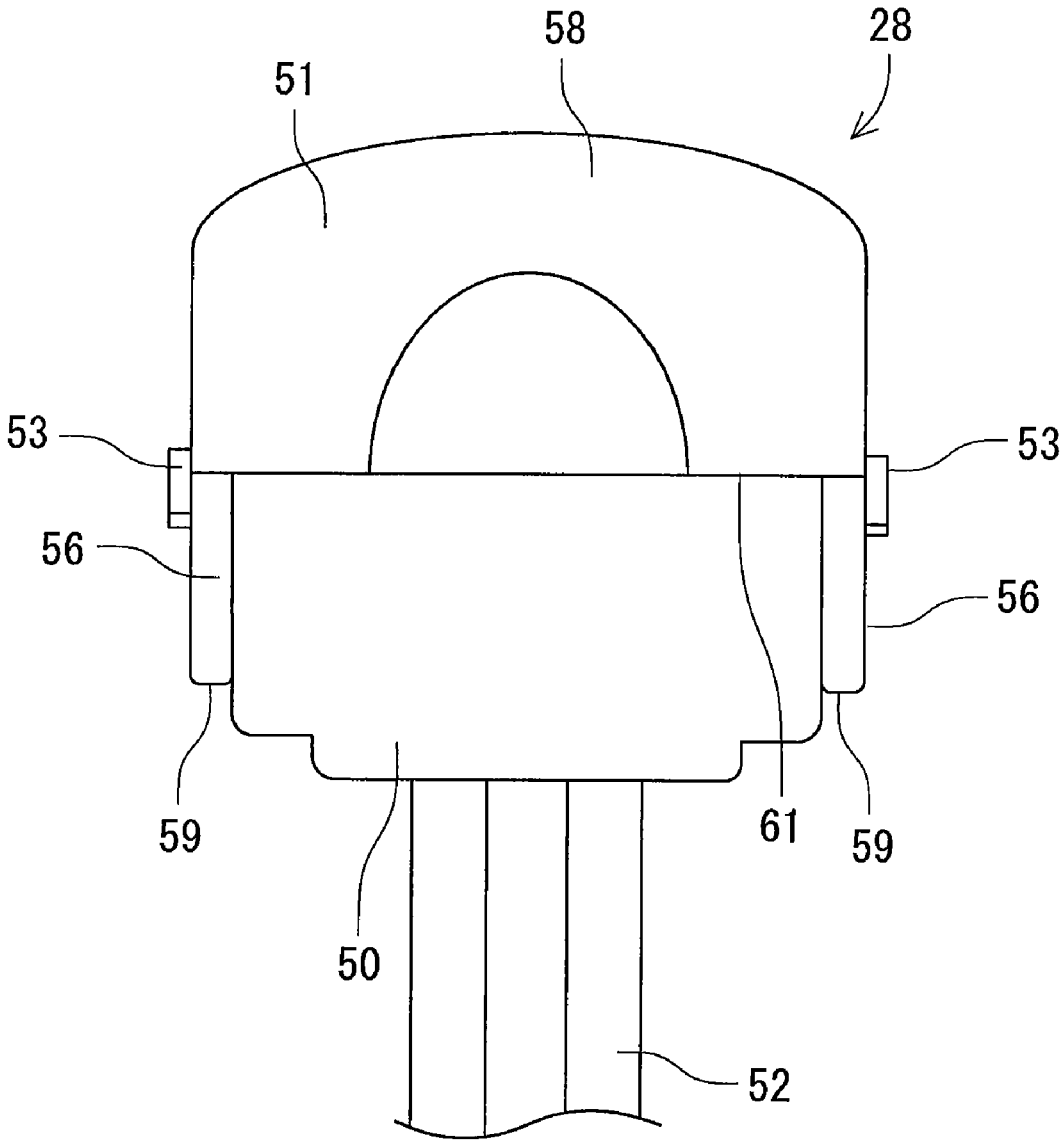
FIG. 8 is a front view of a power plug.
Figure 9:
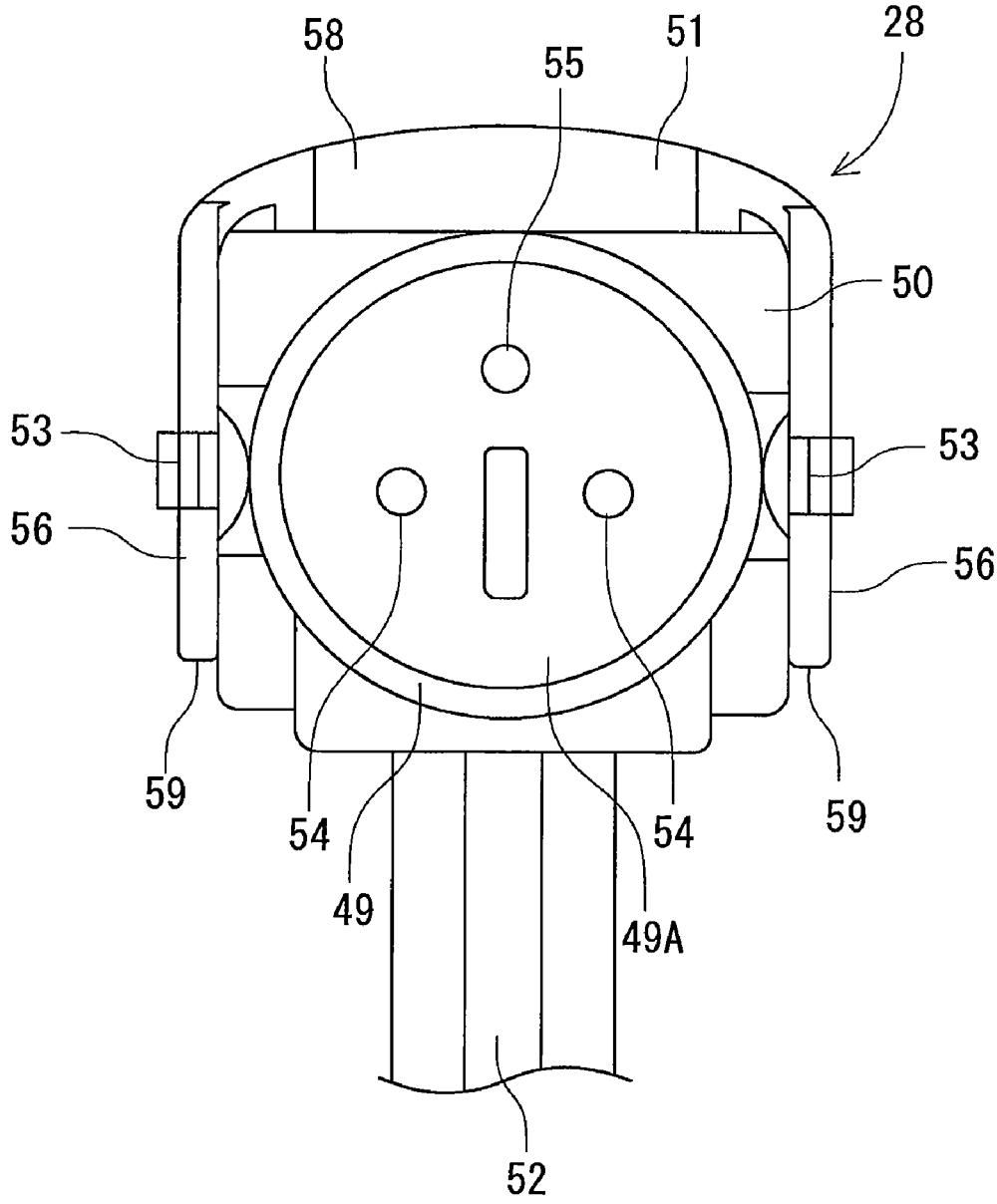
FIG. 9 is a back view of the power plug.
Figure 10:
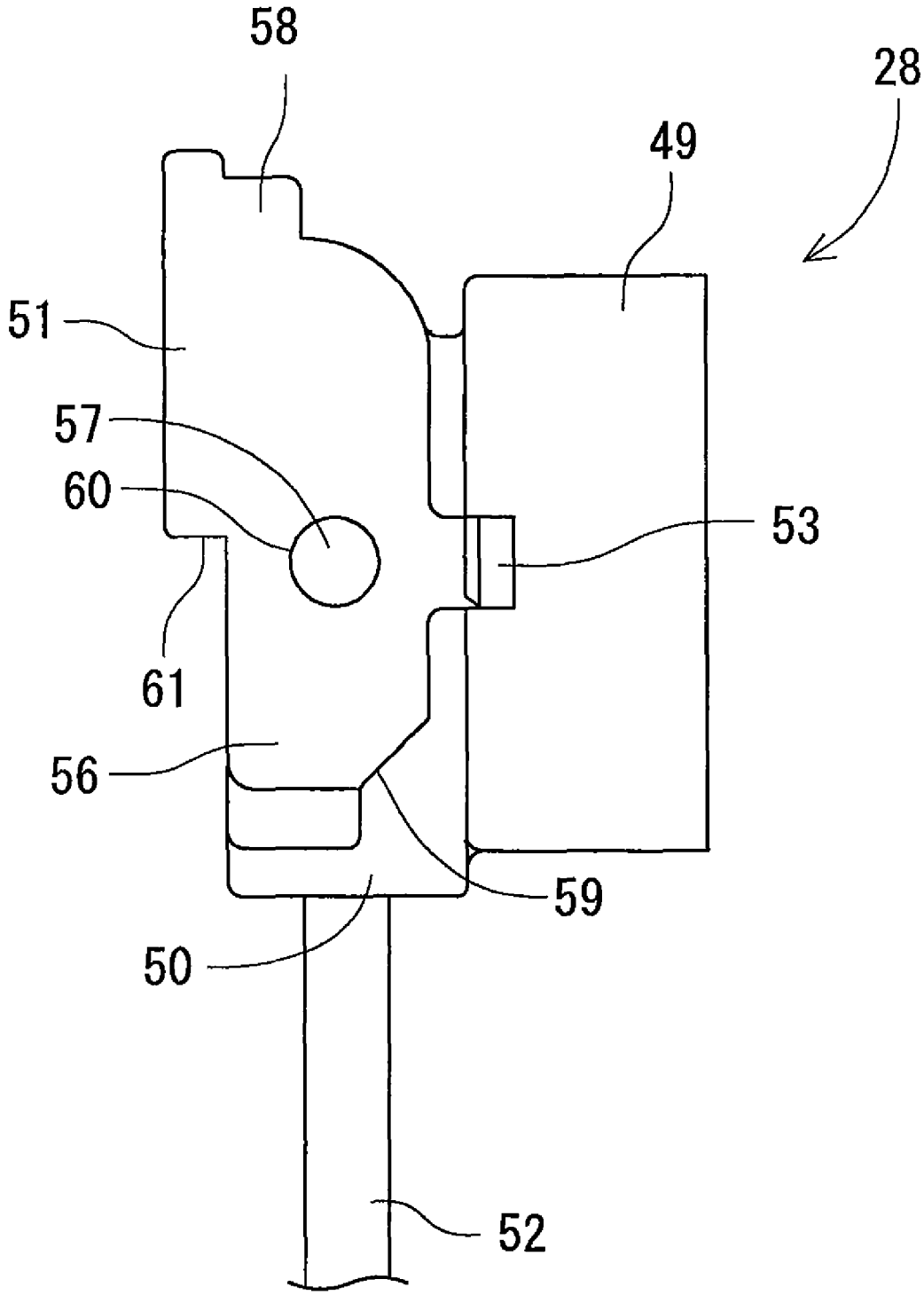
FIG. 10 is a right side view of the power plug (disposed close to the power socket)
Figure 11:
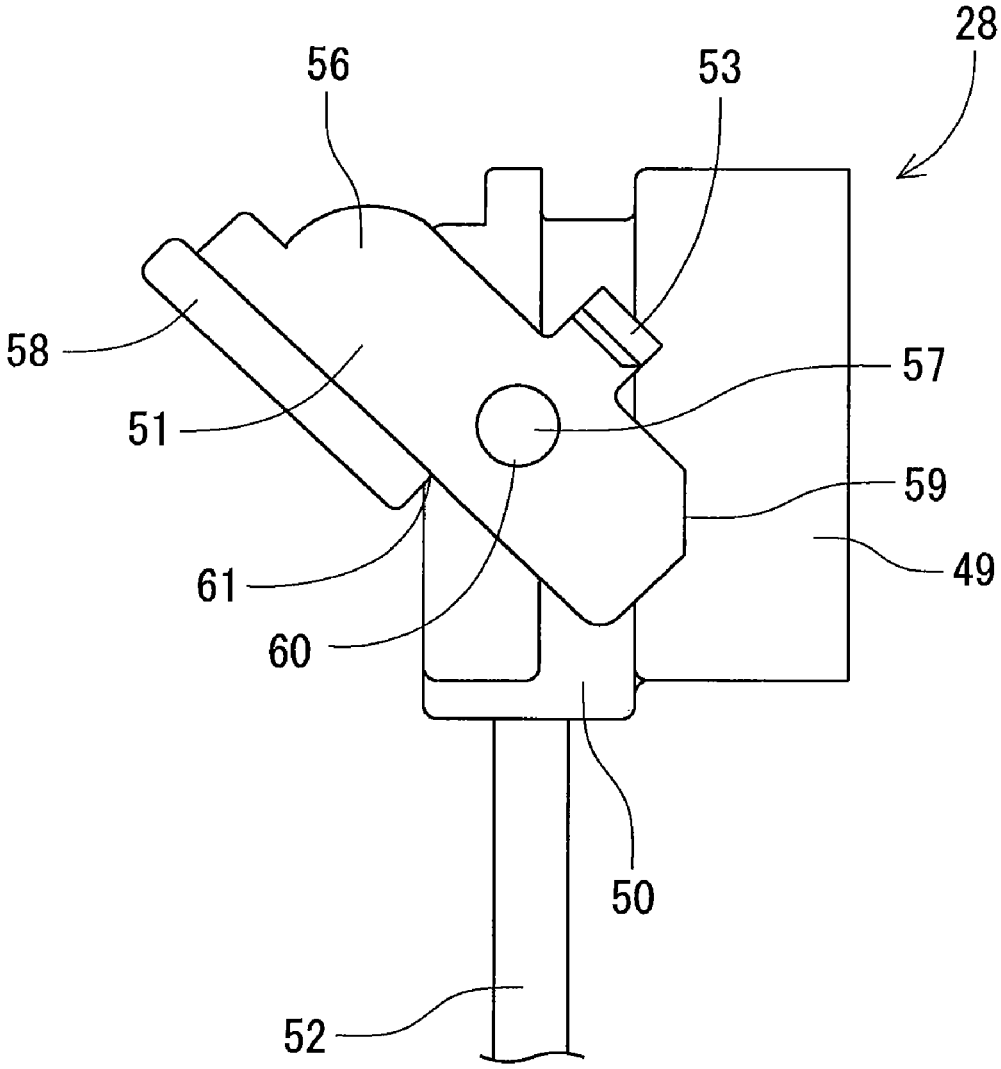
FIG. 11 is a right side view of the power plug (rotated away from the power socket)
Figure 12:
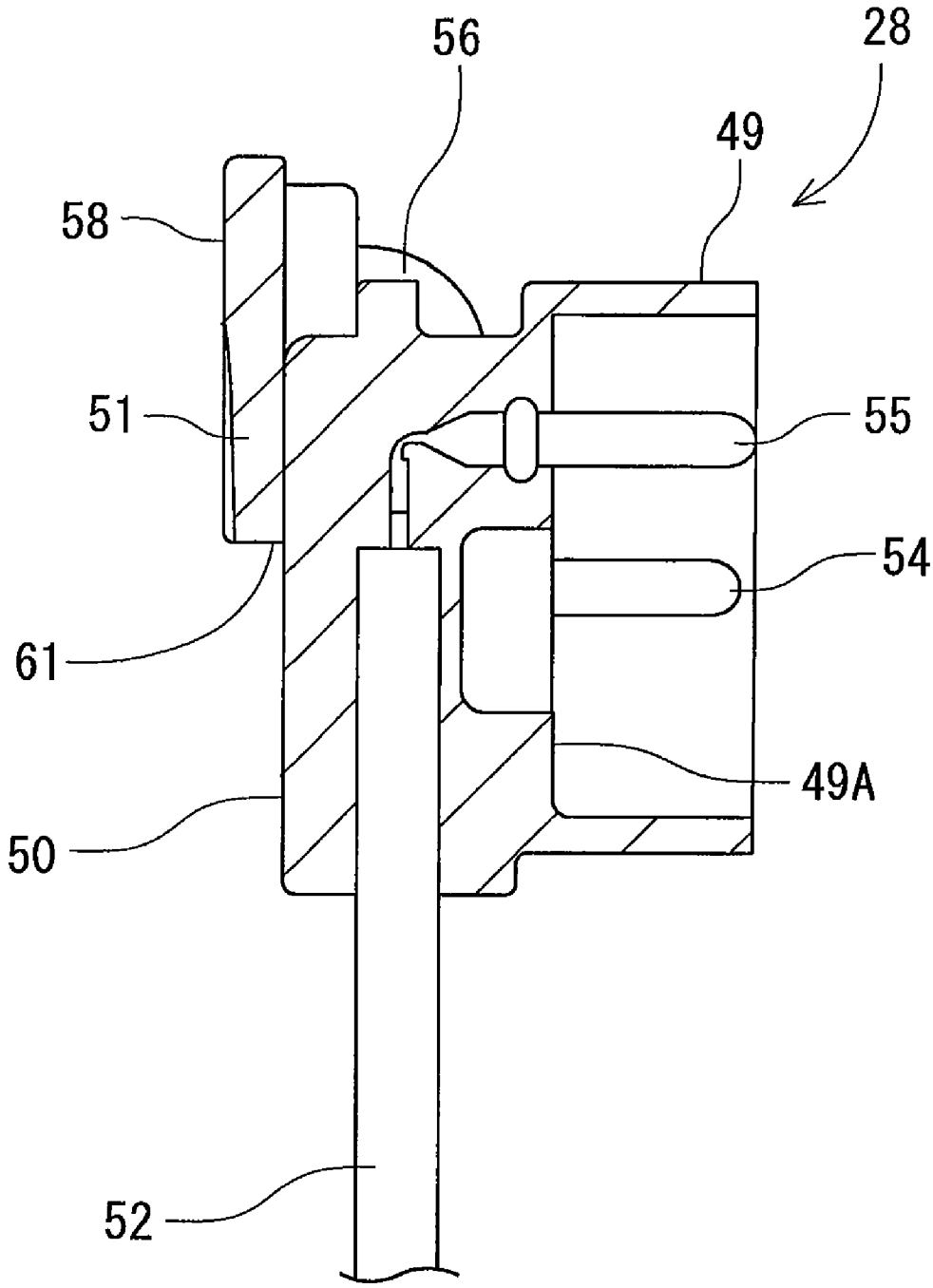
FIG. 12 is a sectional view of FIG. 10.
Figure 13:
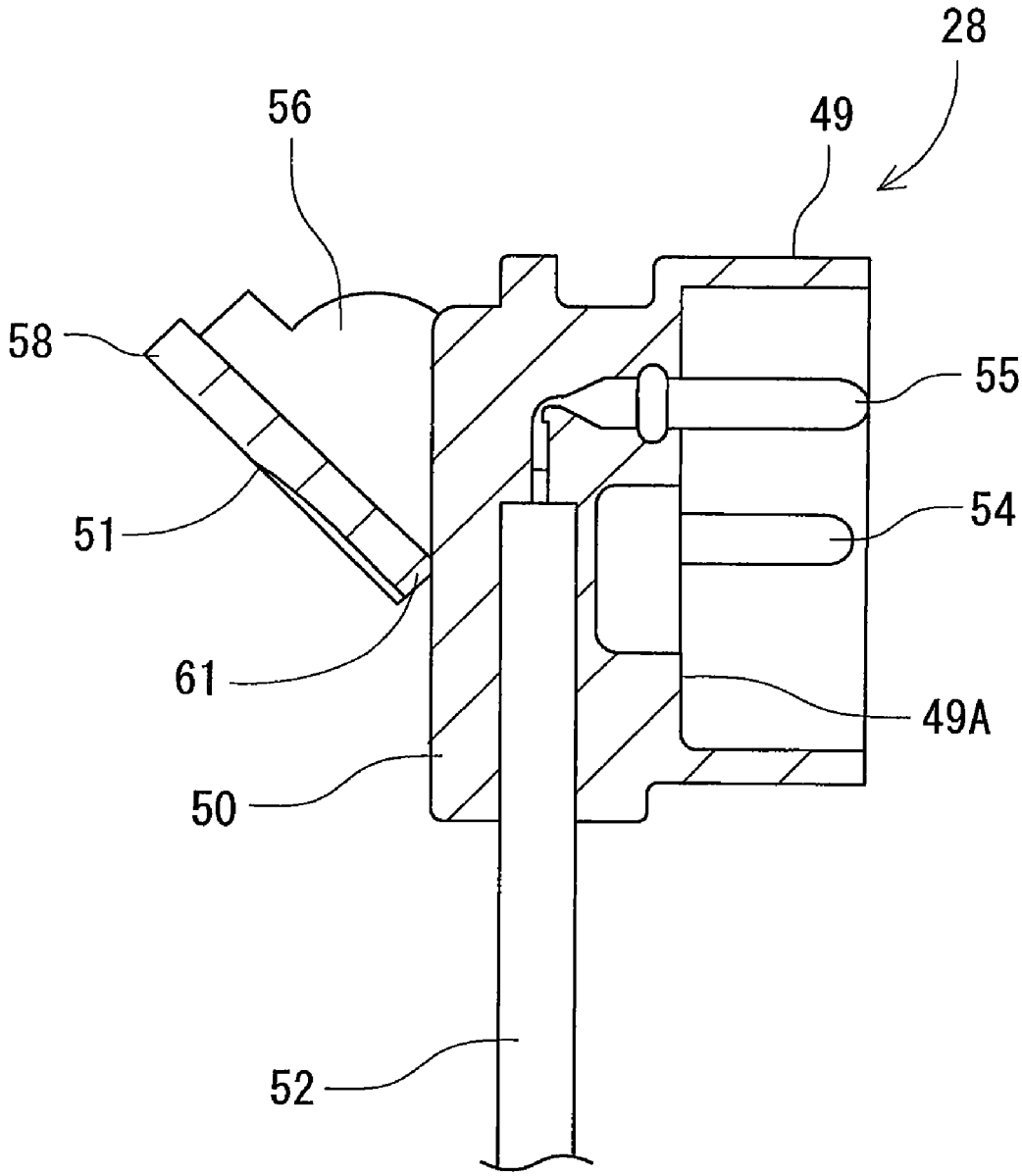
FIG. 13 is a sectional view of FIG. 11.
Figure 14:
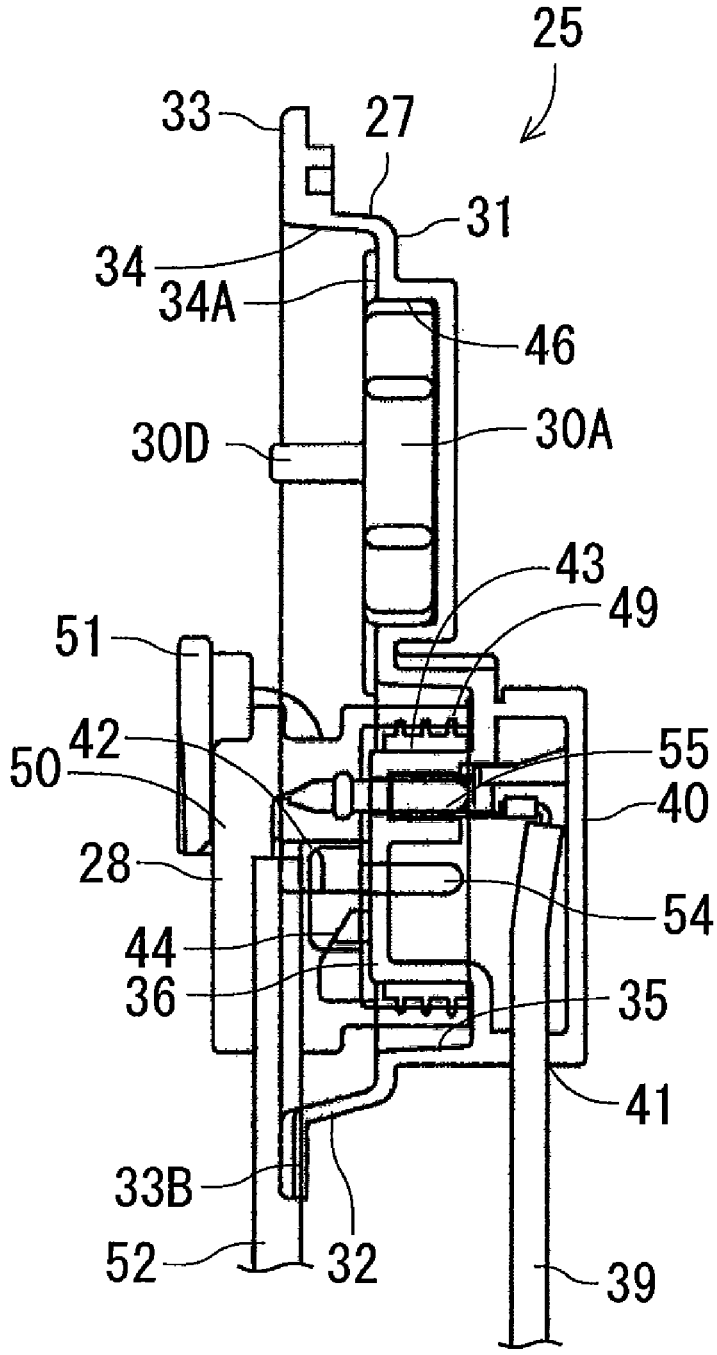
FIG. 14 is a vertical side view of the power connection apparatus of the present invention.

Next, a power connection apparatus 25 of the present invention will be described in detail with reference to FIGS. 2 to 13. FIG. 2 shows a front view of the power connection apparatus 25, FIG. 3 shows a front view of a power socket 27, FIG. 4 shows a back view of the power socket 27, FIG. 5 shows a right side view of the power socket 27, FIG. 6 shows a vertical side view of the power socket 27, FIG. 7 shows a front view of the power socket 27 to which a drip-proof cover 30 is attached, FIG. 8 shows a front view of a power plug 28, FIG. 9 shows a back view of the power plug 28, FIG. 10 shows a right side view of the power plug 28 (rotated toward a power socket 27 side), FIG. 11 shows a right side view of the power plug 28 (rotated away from the power socket 27), FIG. 12 shows a sectional view of FIG. 10, FIG. 13 shows a sectional view of FIG. 11, and FIG. 14 shows a vertical side view of the power connection apparatus 25, respectively.

The power connection apparatus 25 in the present embodiment is an apparatus for supplying a power to the illuminative lamps 14 and 16 used to illuminate the inside of the display chamber 5 of the low temperature showcase 1 as described above, and the apparatus is constituted of a power socket 27 installed on the partition plate 6 constituting the back surface of the display chamber 5 of the low temperature showcase 1 and a power plug 28 plugged in the power socket 27 to supply the power to the illuminative lamps 14 and 16. In the present embodiment, the power connection apparatus 25 is provided for each of the illuminative lamps 14 and 16, and hence the partition plate 6 is provided with a plurality of vertically arranged power sockets. For example, the number of the power sockets 27 equal to or more than that of the illuminative lamps 14 are provided along a support 64.

Figure 6:
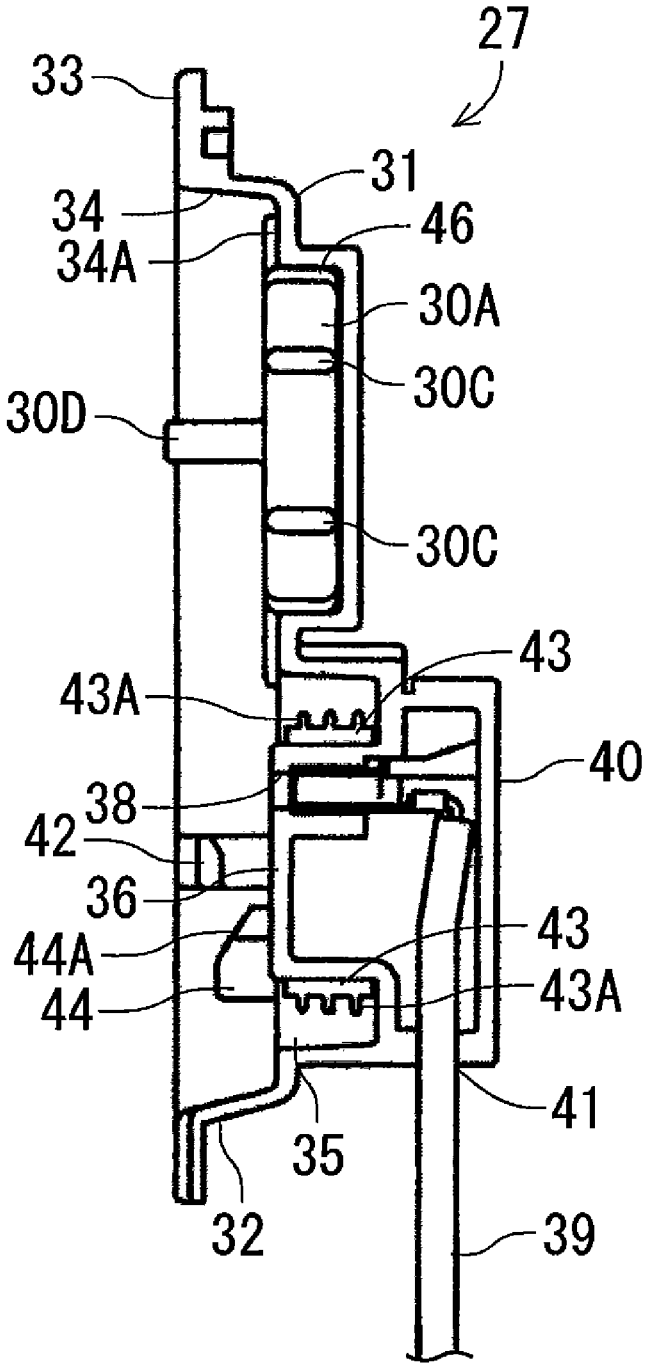
FIG. 6 is a vertical side view of the power socket.

As shown in the sectional view of FIG. 6, the power socket 27 is constituted of a substantially rectangular container-like attachment base 31 made of a hard synthetic resin or the like. An outward flange 33 is formed at the end of an outer peripheral wall 32 constituting the attachment base 31. It is to be noted that in the diagram, reference numeral 33B is a recess portion which receives a lead wire 52 of the power plug 28 connected to an electrode portion 36 described later. Moreover, the outward flange 33 is provided with fixing claws 33A positioned on a side opposite to the connection side of the power plug 28 to hold the partition plate 6 of the showcase 1.

Furthermore, in the attachment base 31, a recess portion 34 is formed inside the outer peripheral wall 32. A bottom 34A of the recess portion 34 is provided with a ring-shaped groove 35, and in the groove 35, an electrode portion 36 projecting toward the opening side of the recess portion 34 is formed. The electrode portion 36 is provided with two power source plug-in ports 37 and one grounding plug-in port 38. The power source plug-in ports 37 and the grounding plug-in port 38 are electrically connected to corresponding lead wires 39 from the side of the bottom 34A of the recess portion 34.

Here, the lead wires 39 connected to the plug-in ports 37 and 38 are drawn to the outside from a lead wire drawing portion 41 formed in the outer peripheral wall 32, and the bottom of the recess portion 34 is closed with a detachably attached closing member 40.

Moreover, a ring-shaped seal member 43 is attached to the outer peripheral surface of the electrode portion 36. In the present embodiment, the seal member 43 is made of a rubber material, and the outer surface of this member is provided with a plurality of ring-shaped projections 43A . . . disposed with a predetermined space therebetween over a depth direction. In consequence, the power plug 28 connected to the electrode portion 36 or the drip-proof cover 30 can stably be held in a watertight manner as described later in detail.

Furthermore, on the inner surface side of the outer peripheral wall 32 constituting the recess portion 34 of the attachment base 31 of the power socket 27, engagement portions 42 and 42 are formed to be disengageably engaged with engaging claws 53 formed in the power plug 28. Each of the engagement portions 42 projects as much as a predetermined dimension to the inside therefrom with a predetermined space between the engagement portion and the bottom 34A of the recess portion 34. In the present embodiment, the engagement portions 42 are formed at two positions to face each other.

The outer edge of the groove 35 including the electrode portion 36 of the attachment base 31 is provided with projecting portions 44 positioned outside the engagement portions 42. Each of the projecting portions 44 is formed so as to project as much as a predetermined dimension from the bottom 34A of the recess portion 34 to the opening side, i.e., a connected power plug 28 side. The projecting portions 44 abut on an abutment portion 59 formed in the power plug 28 during at least an attachment/detachment operation by the operation of a handle 51, and the projecting portions are provided with inclined faces 44A inclined upwardly to the outside from the side of the engagement portions 42 to realize the stable sliding of the abutment portion.

Furthermore, in the bottom 34A of the recess portion 34 of the attachment base 31, a drip-proof cover holding portion 46 substantially circularly depressed to hold the drip-proof cover 30 in the present embodiment is disposed beside (in parallel with) the electrode portion 36. The drip-proof cover 30 is constituted of a cover portion 30A which openably covers the end face of the electrode portion 36 provided with the power source plug-in ports 37 and the grounding plug-in port 38 and a connection arm 30B which connects the cover portion 30A to the attachment base 31 of the power socket 27.

In the present embodiment, the end face of the electrode portion 36 has a substantially round shape, and hence the cover portion 30A is constituted of a substantially round main body which covers the end face of the electrode portion 36 and a side wall formed at the outer periphery of the main body so as to abut on and fit into the side wall of the electrode portion 36. This side wall is provided with a plurality of outward projections 30C . . . , and is disengageably engaged with the drip-proof cover holding portion 46 owing to the elasticity of the projections 30C. Moreover, the outer surface of the cover portion 30A is provided with a grasping portion 30D for performing the attachment/detachment operation.

One end (the tip) 30E of the connection arm 30B is rotatably pivotally supported around a rotary shaft 47 by the bottom 34A of the attachment base 31. At this time, the tip 30E of the connection arm 30B is provided in the bottom 34A so as to be positioned with a substantially equal distance from the drip-proof cover holding portion 46 and from the electrode portion 36, respectively.

Moreover, the connection arm 30B projects from a position different from a position where a line connecting the tip 30E pivotally supported by the rotary shaft 47 to the center of the cover portion 30A intersects with the cover portion 30A, and is extended toward the tip 30E. In the present embodiment, the connection arm 30B substantially perpendicularly projects to the outside from a position away from the electrode portion 36 in a state where the cover portion 30A is held by the drip-proof cover holding portion 46, and is then extended toward the tip 30E positioned with the substantially equal distance from the drip-proof cover holding portion 46 and from the electrode portion 36 while curving along the shape of the inner surface of the outer peripheral wall 32 of the attachment base 31.

The connection arm 30B has a predetermined elasticity. The connection arm is extracted to the outside therefrom by manually holding the grasping portion 30D in a state where the cover portion 30A is held by the drip-proof cover holding portion 46 as shown in FIG. 3, whereby the cover portion 30A is detached from the drip-proof cover holding portion 46 via the connection arm 30B owing to the elasticity of the projections 30C while keeping a state where the cover portion 30A is attached to the attachment base 31. Subsequently, the connection arm 30B and the cover portion 30A are rotated around the rotary shaft 47 around which the tip 30E of the connection arm 30B is pivotally supported on the electrode portion 36 side, and the cover portion 30A is pressed toward the end face of the electrode portion 36, whereby the cover portion 30A can be fitted into the electrode portion 36 (see FIG. 7). It is to be noted that an operation reverse to the above operation is performed to remove the drip-proof cover 30 from the electrode portion 36.

In consequence, the drip-proof cover 30 can cover the electrode portion 36 in a state where terminals 54 and 55 of the power plug 28 are not connected to the electrode portion 36, which can suppress disadvantages that the electrode portion 36 is exposed to the cold air circulated through a chamber and that dew condensation water invades the inside in a state where the power plug 28 is not connected to the power socket 27.

The drip-proof cover 30 can be held by the drip-proof cover, holding portion 46 formed in the attachment base 31, and hence even when the power plug 28 is connected to the power socket 27 and used, it is not necessary to separately store the only drip-proof cover 30, and it is possible to avoid a disadvantage that the drip-proof cover 30 is lost.

Moreover, since the cover portion 30A is provided with the connection arm 30B as described above, the cover portion 30A can only move along the minimum track while keeping the state where the cover portion is attached to the attachment base 31 via the connection arm 30B, to realize the fitting into the electrode portion 36 and the holding by the drip-proof cover holding portion 46. In this case, the attachment/detachment operation to/from the electrode portion 36 and the drip-proof cover holding portion 46 involves an outwardly extracting operation. However, in the present embodiment, as to the connection arm 30B connecting the cover portion 30A to the attachment base 31, the length of the connection arm 30B can further be increased in the limited space of the attachment base 31, and the length required during the attachment/detachment to/from the electrode portion 36 or the drip-proof cover holding portion 46 can be achieved by the elasticity of the connection arm.

In consequence, it is possible to improve the attachment/detachment operation properties of the drip-proof cover 30 to/from the electrode portion 36 and the drip-proof cover holding portion 46 while preferably pivotally supporting the drip-proof cover 30 in the attachment base 31 of the power socket 27.

It is to be noted that in the present embodiment, the drip-proof cover holding portion 46 formed in the attachment base 31 has a substantially circularly recessed shape, and the projections for holding the drip-proof cover 30 by the drip-proof cover holding portion 46 are formed in the cover portion 30A, whereby the cleaning properties of the drip-proof cover holding portion 46 on the attachment base 31 side can be improved.

Next, the power plug 28 connected to the electrode portion 36 of the power socket 27 will be described. The power plug 28 comprises a main body 50 and a cylindrical portion 49 formed of a synthetic resin or the like, and the handle 51 rotatably provided in the main body 50.

A bottom 49A positioned inside the cylindrical portion 49 is provided with two power source terminals 54 and one grounding terminal 55 as shown in FIG. 9, and the terminals 54 and the like are received in the cylindrical portion 49. The power source terminals 54 and the grounding terminal 55 are electrically connected to the lead wires 52 of the illuminative lamps 14 and 16 attached to the inside of the display chamber 5.

Moreover, the handle 51 is rotatably provided at the end of the outer surface of the main body 50 of the power plug 28. That is, as shown in FIG. 8, the handle 51 is positioned on the surface of the power plug 28 opposite to the cylindrical portion 49 of the main body 50, and arm portions 56 and 56 provided at both side portions of the main body are rotatably pivotally supported by rotary shafts 57 and 57 projecting to the outside from both side surfaces of the main body 50.

In FIG. 10, the power plug 28 is seen from the side of the main body 50. In the present embodiment, each of the arm portions 56 includes a grip portion 58 on the side of connection between both the arm portions 56 and 56 (at one end) and the abutment portion 59 at the end positioned on the lead wire 52 side (at the other end). Moreover, a pivoting portion (a rotation hole) 60 is formed so as to be positioned between the grip portion 58 and the abutment portion 59, to rotatably pivotally support the rotary shaft 57 of the main body 50. It is to be noted that as described above, the abutment portion 59 abuts on the projecting portions 44 of the power socket 27 during the attachment/detachment operation by the operation of the handle 51, and the end face of the abutment portion 59 on the power socket 27 side is an inclined face which is inclined at a predetermined angle.

Moreover, the end faces of the arm portions 56 on the cylindrical portion 49 side are provided with the outward engaging claws 53 which are positioned at the pivoting portion 60 to project toward the cylindrical portion 49 side and the power socket 27 side. The engaging claws 53 are engaging portions which can disengageably be engaged with the engagement portions 42 of the power socket 27 as described above. It is to be noted that positions where the engaging claws 53 are formed are not limited to this example, and each engaging claw may be positioned on the grip portion 58 side from the pivoting portion 60.

Furthermore, the grip portion 58 of the handle 51 is provided with a rotation regulating portion 61 which is formed from the outer end thereof to the pivoting portion 60 so as to abut on the surface of the plug opposite to the terminals 54 and 55. In consequence, when the handle 51 is rotated around the pivoting portion 60, a rotation region is regulated from a position where the surface of the grip portion 58 on the main body 50 side abuts on the plug (FIGS. 10 and 12) to a position where the end face of the rotation regulating portion 61 abuts on the surface of the plug on the main body 50 side (FIGS. 11 and 13).

According to the above constitution, when the power socket 27 is attached to the partition plate 6 as described above, the power socket 27 is attached to a socket hole (not shown) beforehand formed in the partition plate 6 so as to project from the display chamber 5 side to the cold air duct 9 side, and the partition plate 6 is held by the fixing claws 33A and the outward flange 33 of the power socket 27, to fix the power socket 27 to the partition plate 6. In consequence, the opening side of the attachment base 31 of the power socket 27, i.e., the power plug 28 on the connection side is positioned on the display chamber 5 side, and the recess portion 34 on the bottom 34A side is positioned on the cold air duct 9 side.

Next, an operation of attaching/detaching the power plug 28 to/from the electrode portion 36 of the power socket 27 will be described with reference to the above diagrams and additionally with reference to FIGS. 15 to 18 which are diagrams for explaining a connection state between the engaging claws 53 and the engagement portions 42. First, the connecting of the power plug 28 to the electrode portion 36 of the power socket 27 will be described. When the electrode portion 36 is covered with the drip-proof cover 30, the drip-proof cover 30 is removed from the electrode portion 36 to expose the electrode portion 36.

Subsequently, the handle 51 of the power plug 28 is rotated around the pivoting portion 60 to obtain a state where as shown in FIG. 11, the grip portion 58 tilts to the side opposite to the power socket 27 and the abutment portion 59 projects to the power socket 27 side. In this case, a rotation angle from a state where the grip portion 58 of the handle 51 of the power plug 28 abuts on the main body 50 in a direction in which the grip portion 58 rotates away from the power socket 27 is limited to a predetermined angle, i.e., a range less than 90° by the rotation regulating portion 61 which abuts on the surface of the plug opposite to the terminals 54 and 55 (the cylindrical portion 49 side), and further rotation is stopped.

Figure 15:
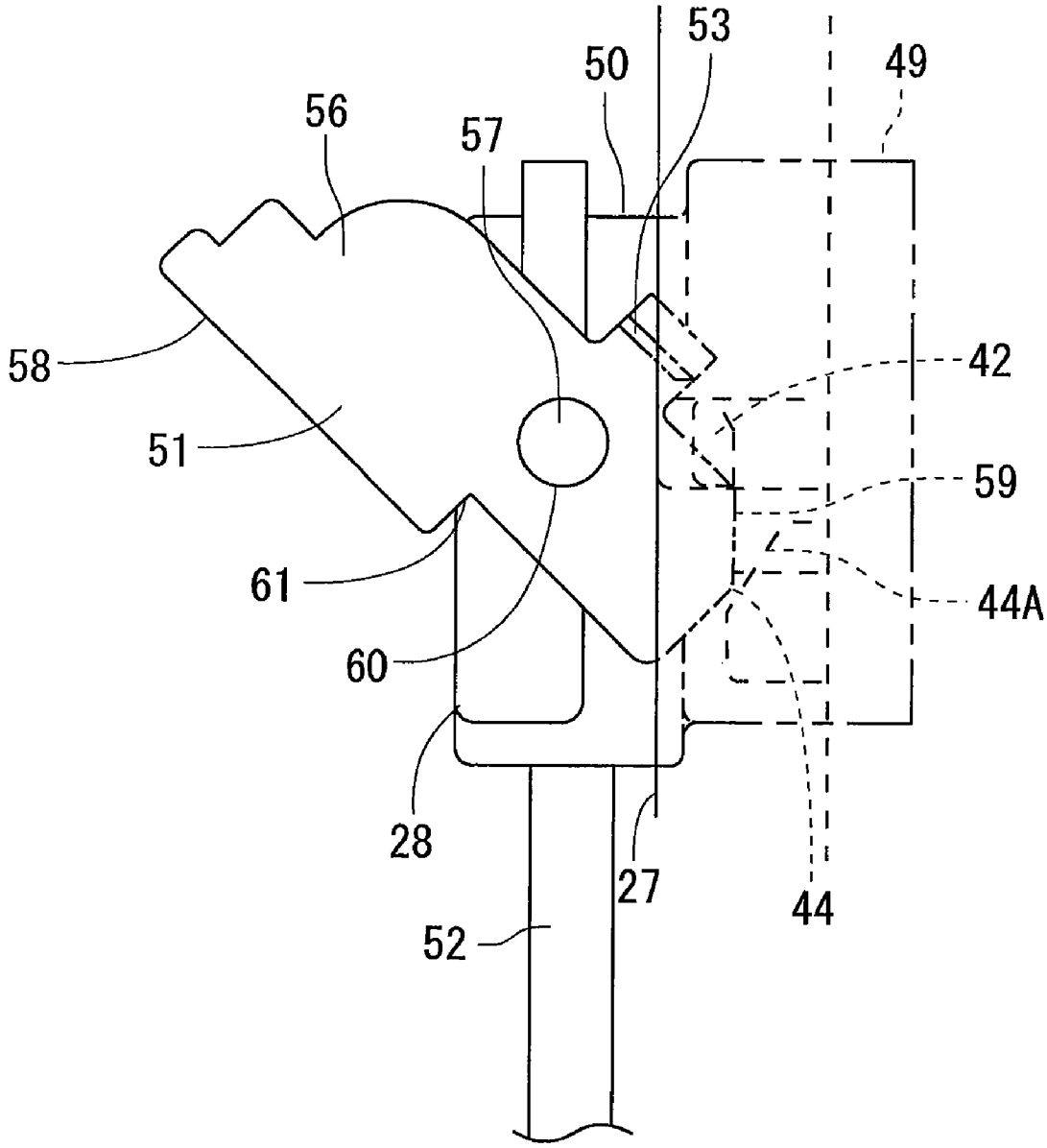
FIG. 15 is an explanatory view of a connection state between engaging claws and engagement portions.

In this state, the cylindrical portion 49 of the power plug 28 is brought close to the electrode portion 36 of the power socket 27, whereby the abutment portion 59 of the power plug 28 abuts on the projecting portions 44 of the power socket 27 (the power plug 28 has a state of FIG. 15). It is to be noted that in a state where the electrode portion 36 slightly enters the cylindrical portion 49, the cylindrical portion 49 is tentatively held by the electrode portion 36 owing to a relation between the inner diameter of the cylindrical portion 49 and the outer diameter dimension of the seal member 43 provided at the outer periphery of the electrode portion 36.

Figure 16:
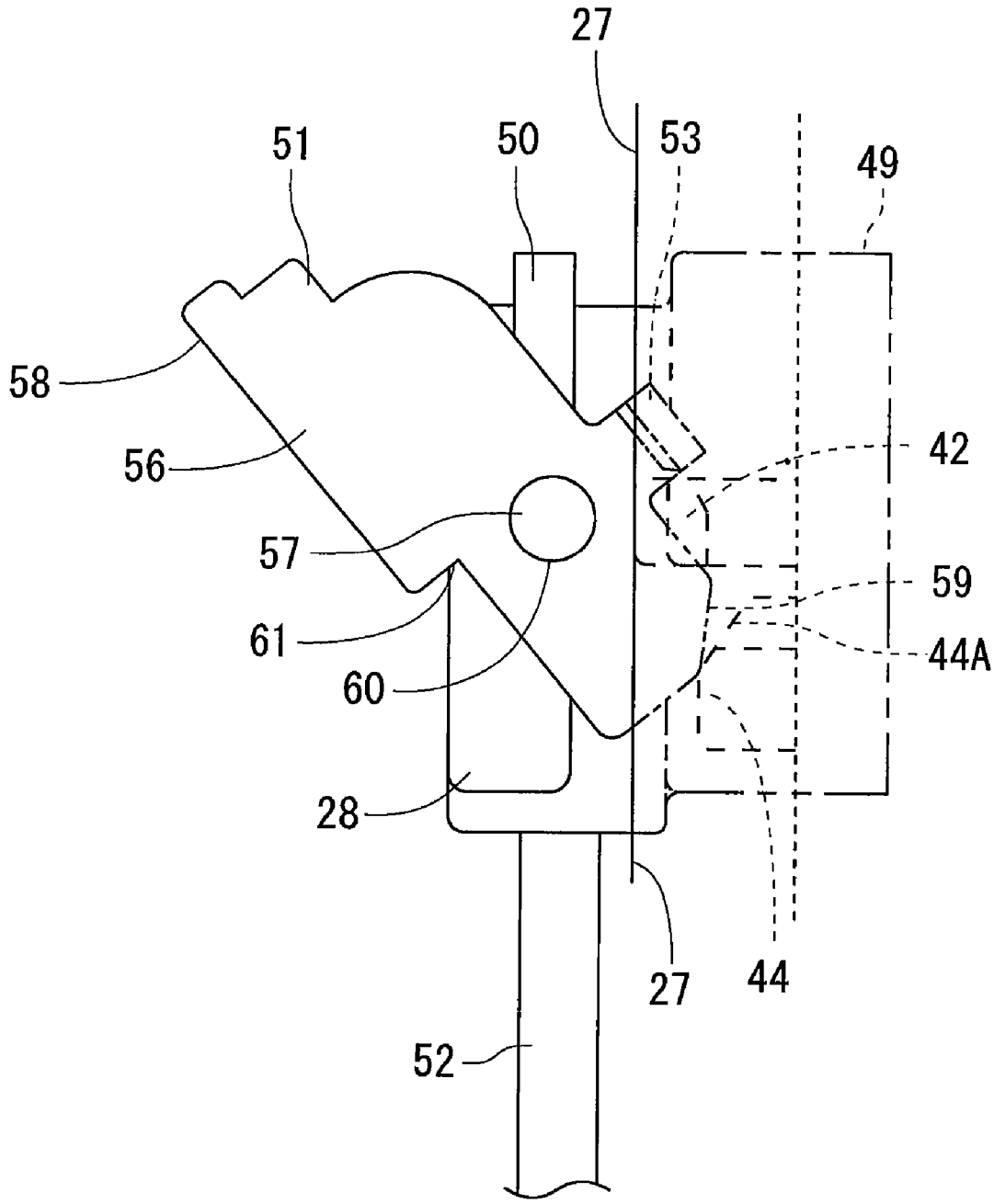
FIG. 16 is an explanatory view of the connection state between the engaging claws and the engagement portions.
Figure 17:
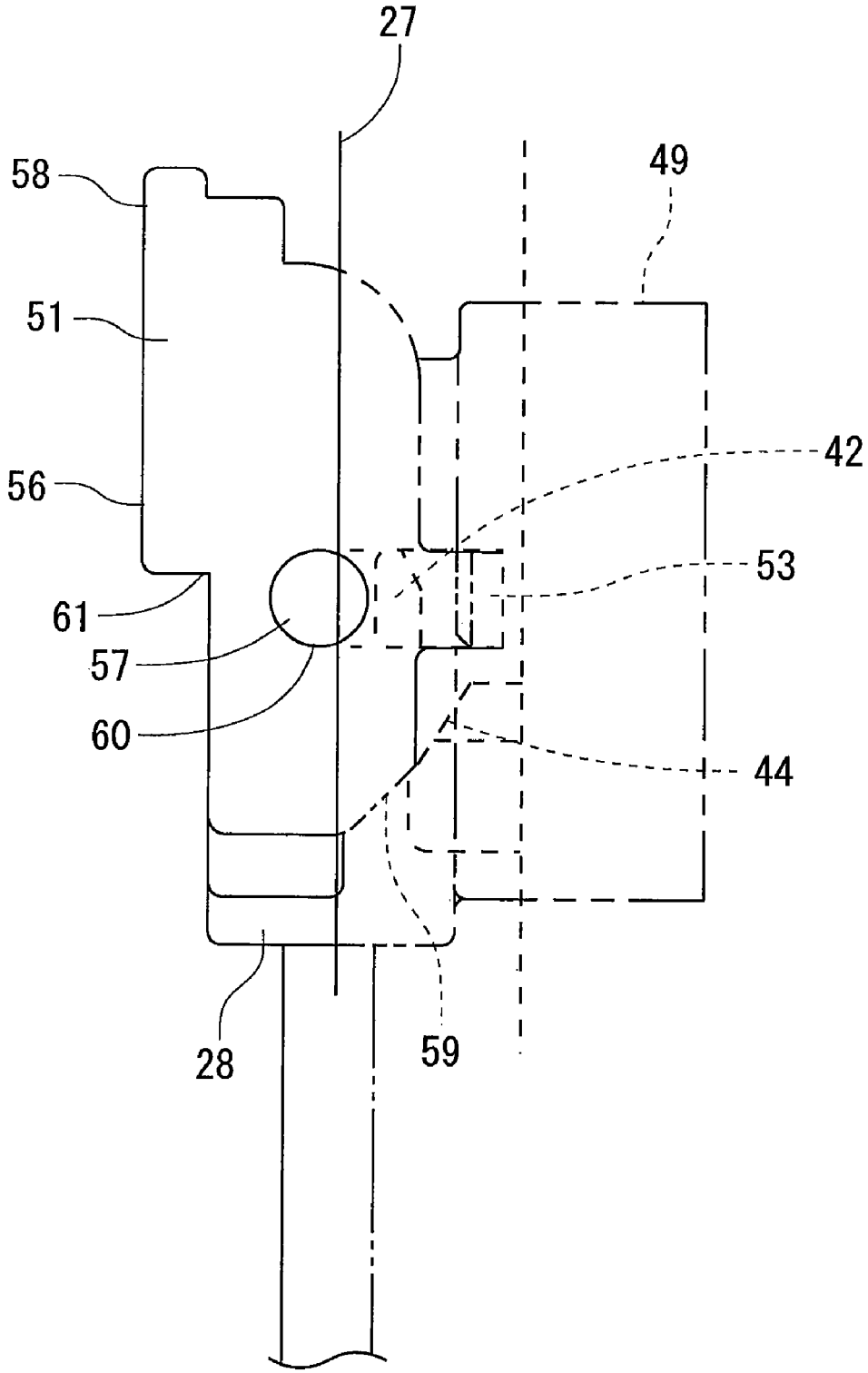
FIG. 17 is an explanatory view of the connection state between the engaging claws and the engagement portions.

Furthermore, the power plug 28 is pressed onto the power socket 27 in a direction in which the terminals 54 and 55 of the power plug 28 are connected to the electrode portion 36 of the power socket 27, whereby the abutment portion 59 of the handle 51 on the power plug 28 side is slidably pressed onto the inclined faces 44A of the projecting portions 44 of the power socket 27. The pivoting portion 60 is rotated around the rotary shaft 57 of the main body 50 in a direction in which the abutment portion 59 comes away from the power socket 27 and the grip portion 58 comes close to the power socket 27 (FIG. 16). In this way, the power plug 28 is pressed in the power socket 27 direction, whereby the handle 51 of the power plug 28 further rotates, and the grip portion 58 abuts on the surface (the outer surface) of the main body 50 opposite to the power socket 27 as shown in FIG. 17.

In this way, the power plug 28 is further pushed into the power socket 27 side in a state where the abutment portion 59 abuts on the projecting portions 44, to rotate the handle 51 in a direction in which the grip portion 58 comes close to the power socket 27, whereby the engaging claws 53 and 53 formed in the handle 51 are smoothly engaged with the engagement portions 42 and 42 formed in the power socket 27. The power plug 28 is pushed into the power socket 27, whereby the power source terminals 54 and the grounding terminal 55 of the power plug 28 are plugged in the power source plug-in ports 37 and the grounding plug-in port 38 of the power socket 27, respectively, to electrically connect the electrode portion 36 to the terminals 54 and 55.

At this time, the rotation angle of the handle 51 of the power plug 28 is regulated to a predetermined angle by the rotation regulating portion 61. That is, the rotation from a raised state where the engaging claws 53 are engaged with the engagement portions 42 in a direction in which the grip portion 58 comes away from the power socket 27 is regulated so that the angle of intersection with the power socket 27 is less than 90°. The rotation in the direction in which the grip portion 58 comes away from the power socket 27 is limited by the angle of the rotation of the handle 51 in the direction in which the grip portion 58 comes close to the power socket 27 when the abutment portion 59 abuts on the power socket 27.

Therefore, according to a simple constitution, an angle appropriate for the connection between the power plug 28 and the power socket 27 can be obtained. That is, it is possible to obtain a rotatable angle only in the direction in which the abutment portion 59 comes away from the power socket 27, when the abutment portion 59 abuts on the power socket 27 side and the power plug 28 is pressed on the power socket 27 side. In consequence, the angle of the handle 51 can easily be regulated, and productivity can be improved.

Consequently, the operation of pushing the power plug 28 into the power socket 27 can be performed in this state to smoothly rotate the handle 51 in the direction in which the grip portion 58 comes close to the power socket 27 and to engage the engaging claws 53 with the engagement portions 42. This can improve connecting operation properties.

In consequence, the power plug 28 is attached to the power socket 27 not only by the connection between the terminals 54 and 55 and the electrode portion 36 but also by the engagement between the engaging claws 53 on the power plug 28 side and the engagement portions 42 on the power socket 27 side, whereby even under the influence of the growth of frost attached to these components or the like, it is possible to eliminate causes for electric leakage and rust in a case where the power plug 28 drops down from the power socket 27.

On the other hand, when the power plug 28 is detached from the power socket 27, an operator rotates the grip portion 58 formed in the handle 51 of the power plug 28 in the direction in which the grip portion 58 comes away from the power socket 27. In consequence, the pivoting portion 60 of the handle 51 is rotated around the rotary shaft 57 of the main body 50 to first release the engagement between the engaging claws 53 of the power plug 28 and the engagement portions 42 of the power socket 27 as shown in FIG. 16.

Subsequently, the grip portion 58 is further rotated in such a direction as to come away from the power socket 27, and the abutment portion 59 of the handle 51 rotated in such a direction as to come close to the power socket 27 abuts on the projecting portions 44 of the power socket 27, slides along the inclined faces 44A of the projecting portions 44, and is pressed toward the power socket 27 side by the principle of leverage, whereby a force is added in a direction in which the terminals 54 and 55 (the cylindrical portion 49 which has entered the groove 35) are detached from the electrode portion 36 of the power socket 27, to release the electric connection between the electrode portion 36 and the terminals 54 and 55 and to release the engagement between the power plug 28 and the power socket 27.

Therefore, even when the joining between the electrode portion 36 and the cylindrical portion 49 of the power plug 28 by the seal member 43 is strengthened by the use thereof in a low temperature atmosphere, the power plug 28 can smoothly be detached from the power socket 27 by use of a small force for rotating the grip portion 58 away from the power socket 27 owing to the principle of leverage.

In particular, the present embodiment has a constitution in which the abutment portion 59 of the handle 51 abuts on the projecting portions 44 projecting from the power socket 27 side to the power plug 28 side, and hence a dimension from the pivoting portion 60 to the abutment portion 59 can be decreased, which can realize the miniaturization of the grip portion 58 of the handle 51.

In this way, the connection between the power plug 28 and the power socket 27 in the present embodiment can be secured by the engagement between the engaging claws 53 and the engagement portions 42, and the improvement of the connecting operation properties and removal operation properties can be achieved.

Figure 18:
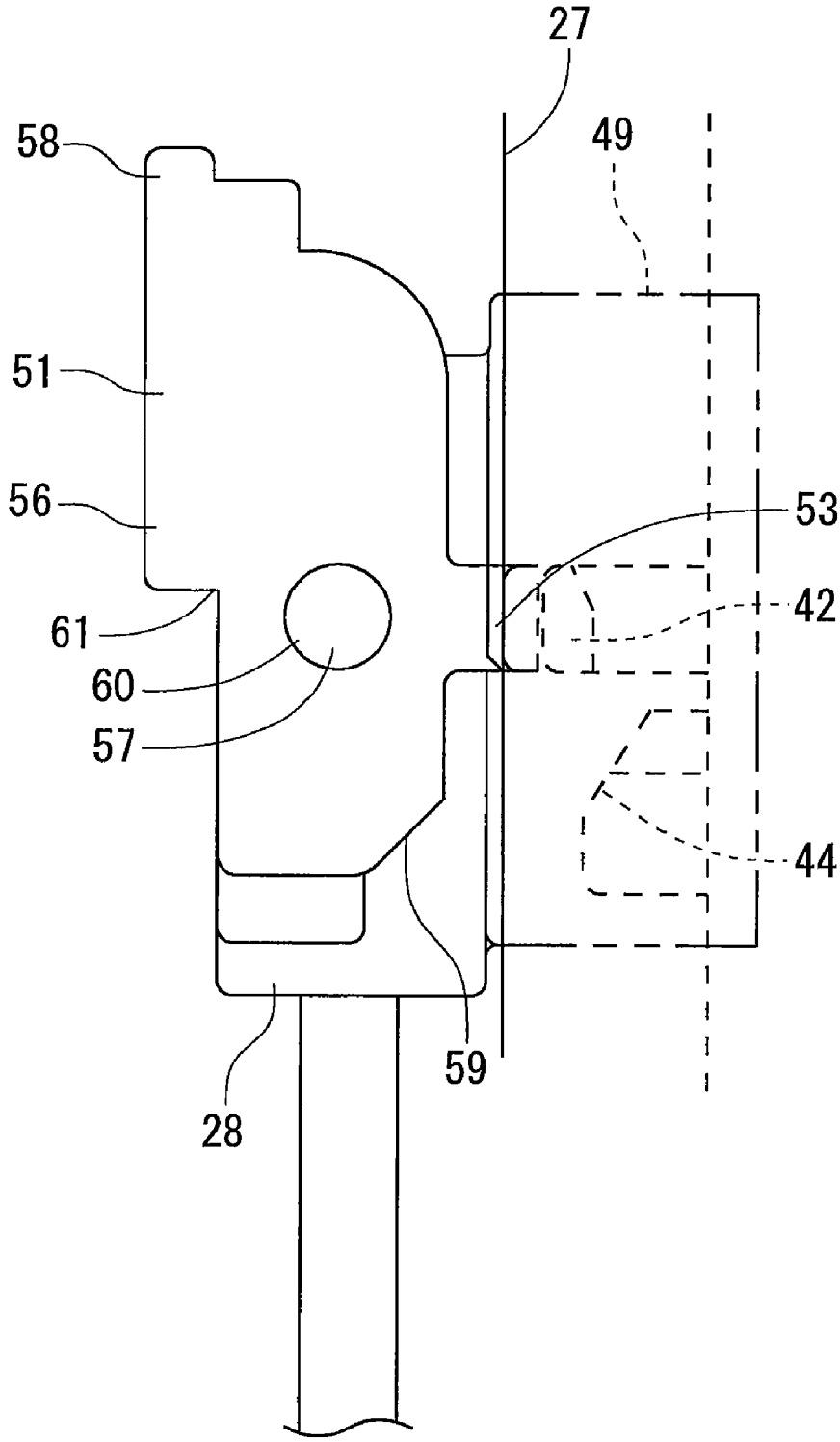
FIG. 18 is an explanatory view of the connection state between the engaging claws and the engagement portions.

It is to be noted that in the power plug 28 of the present embodiment, as shown in FIG. 18, in a state where the grip portion 58 of the handle 51 is rotated to the power socket 27 side, i.e., when the abutment portion 59 of the handle 51 does not project to the power socket 27 side and the cylindrical portion 49 of the power plug 28 is pressed onto the electrode portion 36 of the power socket 27, the engaging claws 53 on the power plug 28 side and the engagement portions 42 on the power socket 27 side, which are made of a material having a predetermined elasticity, are deformed by a force for pushing the power plug 28 into the power socket 27, whereby the engaging claws 53 ride over the engagement portions 42, thereby engaging the engaging claws 53 with the engagement portions 42.

In consequence, the power plug 28 is not influenced by the rotating position of the handle 51, but the power plug 28 can smoothly be attached to and detached from the power socket 27, and the improvement of convenience can be achieved.

What is claimed is:

1. A power connection apparatus which is constituted of a power socket including an electrode portion and a power plug including terminals electrically connected to the electrode portion, the apparatus comprising:

an engagement portion formed in the power socket; and a handle including a grip portion at one end thereof and an abutment portion at the other end, a pivoting portion positioned between the ends being rotatably attached to the power plug, wherein the handle includes engaging claw which is positioned at the pivoting portion or on the side of the grip portion from the pivoting portion to be disengageably engaged with the engagement portion of the power socket, when the power plug is pressed onto the power socket in such a direction as to connect the terminals to the electrode portion and the abutment portion of the handle abuts on the power socket, the handle is rotated in a direction in which the grip portion comes close to the power socket, and the engaging claw engages with the engagement portion, and when the handle is rotated from the state in a direction in which the grip portion comes away from the power socket, the engagement between the engaging claw and the engagement portion and the connection between the electrode portion and the terminals are released, and the rotation of the handle in the direction in which the grip portion comes away from the power socket is limited by the rotation angle of the handle in the direction in which the grip portion comes close to the power socket when the abutment portion abuts on the power socket.

2. A power connection apparatus which is constituted of a power socket including an electrode portion and a power plug including terminals electrically connected to the electrode portion, the apparatus comprising:

an engagement portion formed in the power socket; and a handle including a grip portion at one end thereof and an abutment portion at the other end, a pivoting portion positioned between the ends being rotatably attached to the power plug, wherein the handle includes engaging claw positioned at the pivoting portion or on the side of the grip portion from the pivoting portion to be disengageably engaged with the engagement portion of the power socket, when the power plug is pressed onto the power socket in such a direction as to connect the terminals to the electrode portion and the abutment portion of the handle abuts on the power socket, the handle is rotated in a direction in which the grip portion comes close to the power socket, and the engaging claw engages with the engagement portion, and when the handle is rotated from the state in a direction in which the grip portion comes away from the power socket, the engagement between the engaging claw and the engagement portion and the connection between the electrode portion and the terminals are released, and the power plug is provided with a rotation regulating structure which stops the rotation of the handle in the direction in which the grip portion comes away from the power socket at a position where an intersection angle with the power socket is less than 90°.

3. The power connection apparatus according to claim 1, wherein the engaging claw can be disengageably engaged with the engagement portion, even when the abutment portion does not abut on the power socket but the power plug is pressed onto the power socket.

4. The power connection apparatus according to claim 1, wherein the power socket comprises a drip-proof cover which covers the electrode portion in a state where the terminals of the power plug are not connected to the electrode portion.

5. The power connection apparatus according to claim 4, wherein the power socket comprises a holding portion disposed beside the electrode portion to detachably hold the drip-proof cover, the drip-proof cover comprises a connection arm extended with an elasticity and having a tip rotatably supported by the power socket, and the connection arm projects from a position different from a position where a line connecting the tip to the center of the drip-proof cover intersects with the drip-proof cover, and extends toward the tip thereof.

6. The power connection apparatus according to claim 1 or 2, wherein the handle abuts on the surface of the power plug opposite to the terminals, to limit or stop the rotation of the handle.

* * * * *